US010054353B2

(12) United States Patent
Kendrick

(10) Patent No.: US 10,054,353 B2
(45) Date of Patent: Aug. 21, 2018

(54) CHEST COOLER INSERT

(71) Applicant: Ice-Olate USA, LLC, Nibley, UT (US)

(72) Inventor: Bryan W. Kendrick, Nibley, UT (US)

(73) Assignee: Ice-Olate USA, LLC, Salt Lake City, UT (US)

( * ) Notice: Subject to any disclaimer, the term of this patent is extended or adjusted under 35 U.S.C. 154(b) by 325 days.

(21) Appl. No.: 14/993,638

(22) Filed: Jan. 12, 2016

(65) Prior Publication Data

US 2016/0201971 A1 Jul. 14, 2016

Related U.S. Application Data

(60) Provisional application No. 62/102,507, filed on Jan. 12, 2015.

(51) Int. Cl.
*F25D 3/04* (2006.01)

(52) U.S. Cl.
CPC ..... *F25D 3/045* (2013.01)

(58) Field of Classification Search
CPC . F25D 3/045; F25D 3/08; F25D 23/08; F25D 25/02; F25D 2303/081; F25D 2325/021
USPC ..... 62/459
See application file for complete search history.

(56) References Cited

U.S. PATENT DOCUMENTS

| | | | | |
|---|---|---|---|---|
| 1,724,921 | A * | 8/1929 | Hall | F25D 3/045 62/529 |
| 4,307,581 | A | 12/1981 | Reid | |
| 4,478,337 | A | 10/1984 | Flum | |
| 5,931,019 | A | 8/1999 | White et al. | |
| 6,050,663 | A | 4/2000 | Schoellmann | |
| 6,126,124 | A * | 10/2000 | Wagner | A45C 11/20 248/127 |
| D448,249 | S | 9/2001 | DeCastro et al. | |
| 6,405,557 | B1 | 6/2002 | DeCastro et al. | |
| 7,313,928 | B2 | 1/2008 | Girard | |
| 8,065,889 | B1 | 11/2011 | Silberman | |
| 2004/0069009 | A1 | 4/2004 | Tedder | |
| 2007/0012069 | A1 | 1/2007 | Girard | |
| 2007/0186579 | A1 | 8/2007 | Barker | |

* cited by examiner

*Primary Examiner* — Cassey D Bauer
(74) *Attorney, Agent, or Firm* — Ramey & Schwaller, LLP

(57) ABSTRACT

Inserts for holding items stored in a cooler above the bottom of the cooler so that condensation or ice melt drains below the items. In one illustrative embodiment, the insert has a base portion that serves as a shelf for holding items stored in a cooler above the bottom thereof, which has a drainage structures to allow ice melt to flow underneath the base and away from the items. The base may be formed of one or more separate pieces and may be adjustable in size for use in different coolers. Adjustment features may include removably attachable extensions and base components that are slidably adjustable to form a complete base member of a desired size.

18 Claims, 7 Drawing Sheets

CHEST COOLER INSERT

CROSS REFERENCE TO RELATED APPLICATIONS

This application claims priority to and incorporates by reference all of the subject matter included in Provisional Patent Application Ser. No. 62/102,507, which was filed Jan. 12, 2015.

TECHNICAL FIELD

The present disclosure relates to chest coolers and to inserts for chest coolers.

BACKGROUND

Conventional chest coolers store a coolant (typically ice or freezer packs) with items to be kept cool. As heat is absorbed by the coolant, it can melt or accumulate ambient moisture. The moisture may then accumulate in the bottom of the interior of the cooler. Generally, the items to be kept cool also sit on the bottom surface of the cooler and become moistened by the melted ice or collected condensation accumulated in the bottom of the cooler. This may be undesirable as it may affect the stored items negatively. For example, the items may become spoiled, damaged, or contaminated. This may frustrate the utility of the cooler and further create a situation that may require substantial effort to clean.

SUMMARY

The present disclosure is directed to an insert for holding items stored in a cooler above the bottom of the cooler so that condensation or ice melt drains below the items. In one illustrative embodiment, the insert has a base portion that serves as a shelf for holding items stored in a cooler above the bottom thereof, which has a drainage structures to allow ice melt to flow underneath the base and away from the items. The base may be formed of one or more separate pieces and may be adjustable in size for use in different coolers. Adjustment features may include removably attachable extensions and base components that are slidably adjustable to form a complete base member of a desired size.

DESCRIPTION OF THE DRAWINGS

It will be appreciated by those of ordinary skill in the art that the various drawings are for illustrative purposes only. The nature of the present disclosure, as well as other embodiments thereof, may be more clearly understood by reference to the following detailed description, to the appended claims, and to the several drawings.

Throughout the description, similar reference numbers may be used to identify similar elements.

DETAILED DESCRIPTION

The present disclosure relates to inserts for coolers. It will be appreciated by those skilled in the art that the embodiments herein described, while illustrating certain embodiments, are not intended to so limit this disclosure or the scope of the appended claims. Those skilled in the art will also understand that various combinations or modifications of the embodiments presented herein can be made without departing from the scope of the present disclosure. All such alternate embodiments are within the scope of the present disclosure.

While many embodiments are described herein, at least some of the described embodiments include an insert configurable to be placed on the inside of a conventional cooler. The described embodiments facilitate gravity-fed drainage of liquids through the insert to the bottom of the cooler. In some embodiments, the insert reduces splashing of the liquid back through the insert once it has been drained to the bottom surface of the cooler. In some embodiments, the insert has adjustable feet to separate the insert from the bottom surface of the cooler and accommodate a varied amount of liquid. The insert is sufficiently strong to accommodate the weight of the contents of the cooler placed on the upper surface of the insert.

Figure 1A:
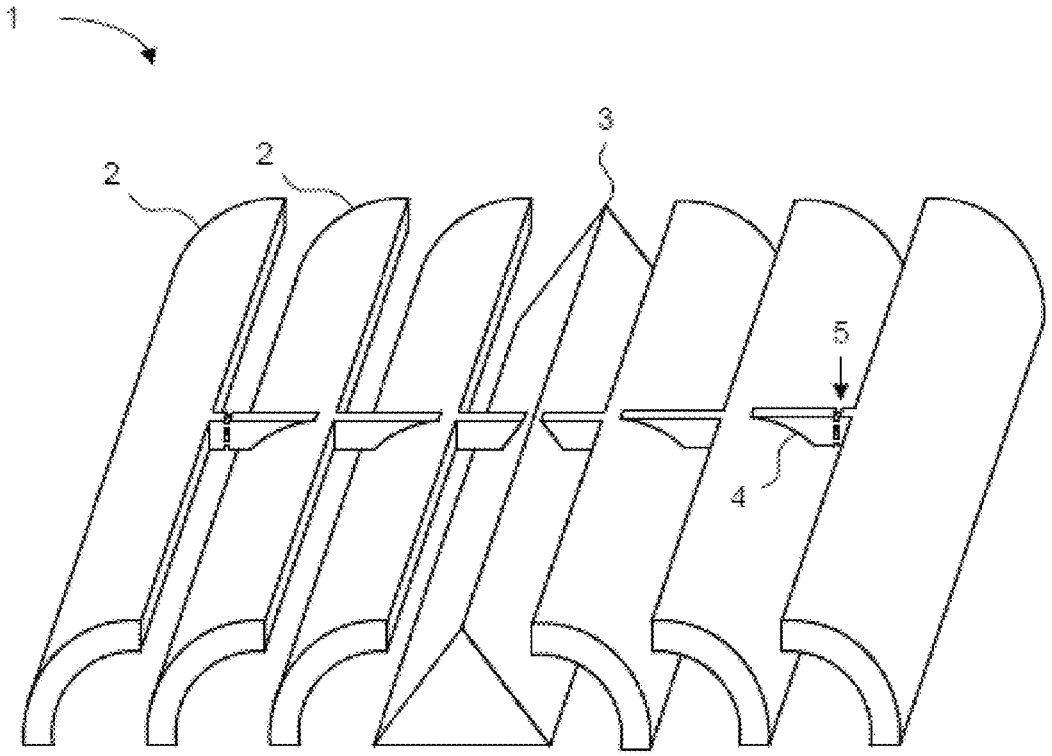
FIGS. 1A-G depict schematic diagrams of various elements of one embodiment of a chest cooler insert with drainage structure slats.

FIG. 1A depicts a perspective view of one embodiment of a cooler insert 1 with drainage structure slats 2. The illustrated embodiment includes drainage structure slats 2, a center portion 3, and connector structures 4. In the illustrated embodiment, the connector structures 4 also include size adaptation regions 5. Although the cooler insert 1 is shown and described with certain components and functionality, other embodiments of the cooler insert 1 may include fewer or more components to implement less or more functionality.

In one embodiment, the insert 1 is an insert for a conventional chest-type cooler. In other embodiments, the insert 1 is compatible with other systems in which it is desirable to allow for drainage of liquid or relatively small particulate through a surface and reduce return of the drained material through the insert 1. In some embodiments, the insert 1 allows for drainage and reduced return of the drained material through the use of slats 2. In the illustrated embodiment, the slats 2 are curved to allow for drainage space between the slats 2. The slats 2 also reduce the amount of drainage material that is allowed to pass back through the slats 2. In the illustrated embodiment, the slats 2 are turned to curve towards the center of the insert 1. In other embodiments, the slats 2 may curve outwards or in multiple directions. The illustrated embodiment includes a center portion 3. In the illustrated embodiment, the center portion 3 has a triangular cross-section. In other embodiments, the center portion 3 has other geometries. In some embodiments, the center portion 3 may be solid throughout or hollow or a mixture of both along the length.

In some embodiments, the insert 1 may be made of a single material such as a plastic, metal, or composite. In another embodiment, each component of the insert may be made of a material chosen to reduce price, simplify manufacturing, or perform a function. For example, the entire insert 1 may be constructed of a plastic for ease of cleaning and durability, or the slats 2 and center portion 3 may be constructed of a metal while the remainder of the insert 1 is constructed of a composite material to enhance thermal conductivity via metal components and strength via composites.

The illustrated embodiment also includes connector structures 4. In the illustrated embodiment, the connector structures 4 span between the slats 2. The connector structures 4 provide the structural rigidity of the insert 1 by joining each of the slats 2. In the illustrated embodiment, the connector structures 4 are placed at the top of the curve of the slats 2 so as to be close to the upper surface of the insert 1. In other embodiments, the connector structures 4 are placed at different locations along the slats 2. In the illustrated embodiment, a single array of connector structures 4 is shown. In some embodiments, the insert 1 includes multiple sets of connector structures 4. In some embodiments, the connector structures 4 may have a relatively small thickness in one dimension. In another embodiment, the connector structures 4 have a substantially symmetrical cross-section.

In the illustrated embodiment, the connector structures 4 also include an adaptation structure 5. In some embodiments, the adaptation structure 5 is a built-in weak region of the connector structures 4. In some embodiments, the adaptation structures 5 would allow for removal of one or more of the slats 2 from the insert 1 to adapt the overall size of the insert 1 to fit within the internal space of a cooler. In some embodiments, the adaptation structure 5 is located near the slat 2 to be removed from the insert 1. In other embodiments, the adaptation structure 5 is located nearer the slat 2 that will remain connected to the remainder of the insert 1. In some embodiments, the adaptation structure 5 is a relatively thinner portion of the connector structure 4. In another embodiment, the adaptation structure 5 is a perforated region of the connector structure 4. In some embodiments, the adaptation structure 5 is a coupler to connect slats 2 together. In this embodiment, the adaptation structure 5 facilitates disconnection and reconnection of slat segments to the insert 1. In other embodiments, the adaptation structures 5 are sacrificial and only allow for disconnection of the slats 2. Other embodiments of the adaptation structure 5 facilitate adaptation of the size of the insert 1 in other ways.

Figure 1B:
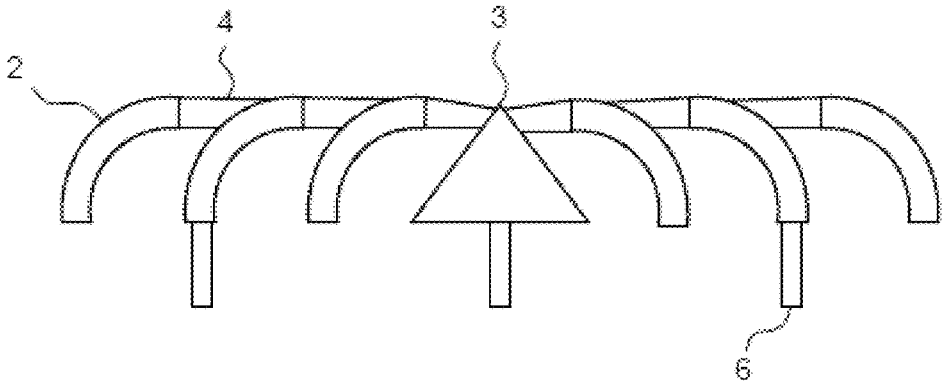

FIG. 1B is a cross-sectional view of the insert 1 of FIG. 1A. The illustrated embodiment of insert 1 includes slats 2, center portion 3, connector structures 4 with adaptation structures 5, and elevation structures 6. The slats 2 of the illustrated embodiment have a simple curved geometry. Other embodiments include other geometries (discussed further below with reference to FIGS. 1C-1E). In the illustrated embodiment, the slats 2 are centered around the center portion 3. In the illustrated embodiment, the center portion 3 has a triangular cross-section. In other embodiments, the center portion 3 has non-triangular geometries.

The illustrated embodiment of insert 1 also includes connector structures 4 oriented between each slat 2. In some embodiments, the connector structures 4 are connected at the top of the slats 2. In other embodiments, the connector structures 4 are located at a different portion of the slats 2. In some embodiments, the connector structures 4 include an adaptation structure 5 built into the connector structure 4. The adaptation structure 5 allows a user to disconnect a portion of the insert 1 at the adaptation structure 5. In some embodiments, the disconnect operation involves breaking the connector structure 4 at the adaptation structure 5. In other embodiments, the adaptation structure 5 facilitates a temporary or reversible disconnect. This would allow the user to temporarily adjust the insert 1 to accommodate a specific application.

The elevation structures 6 of FIG. 1B are coupled to the underside of the slats 2. The elevation structures 5 maintain the slats and the remainder of the insert 1 at some distance from the bottom of a cooler or other surface on which the insert 1 may be placed. In some embodiments, the elevation structures 6 are adjustable. This is described in more detail with reference to FIGS. 1F and 1G.

Figure 1C:
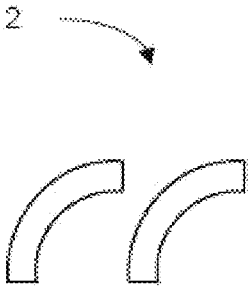

FIG. 1C depicts a cross-sectional view of one embodiment of the slats 2 of the insert 1 of FIG. 1A. In the illustrated embodiment, the slats 2 have a simple, single-curve geometry. In the illustrated embodiment, the slats 2 are arranged in a nested orientation so that each slat 2 is oriented similarly to the proximal slats 2. In another embodiment, the orientation of the slats 2 may vary. For example, the slats 2 may be opposite one another or rotated 180 degrees. Other orientations may be used.

Figure 1D:
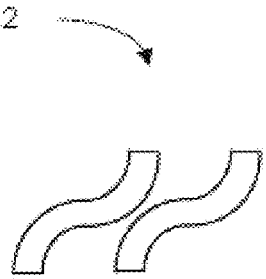
Figure 1E:
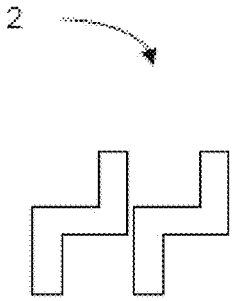

FIGS. 1D-1E illustrate alternate embodiments of the slats 2. These figures are presented to illustrate a few potential embodiments. Other embodiments may incorporate other cross-sectional geometries and orientations or combinations of the slats 2.

Figure 1F:
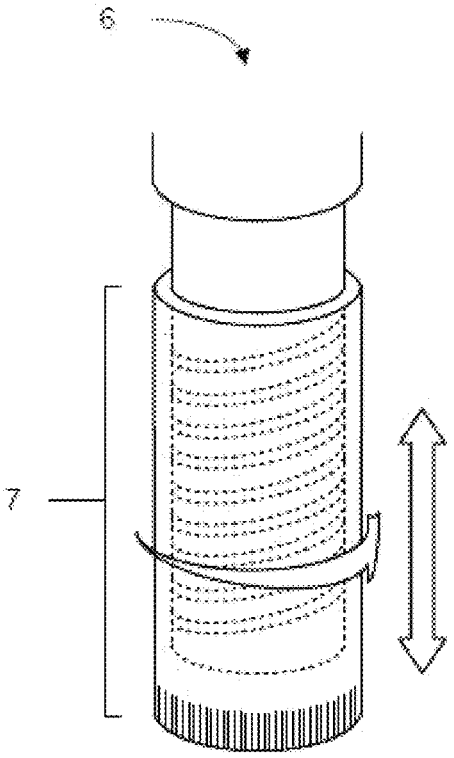

FIG. 1F depicts one embodiment of the elevation structure 6 of FIG. 1B. In the illustrated embodiment, the elevation structure 6 includes an internal surface screw track height adjustment feature. This feature allows a user to twist the elevation structure 6 to adjust the height of the elevation structure 6 and thus the separation distance between the insert 1 and the surface upon which the insert 1 is situated. In the illustrated embodiment, the user twists all of region 7 of the elevation structure 6. In some embodiments, the elevation structure is hollow to allow for storage space. In some embodiments, the elevation structure 6 is sealed so that the internal space within the elevation structure 6 is not penetrable by water or other liquids. In some embodiments, the elevation structure 6 may be of a fixed height with an item stored internally upon manufacture. For example, a survival item such as matches, first aid materials, or flint and steel may be sealed into the elevation structure 6 during manufacture. These materials could be accessed by removing the elevation structure 6 from the insert 1 or only a portion of the elevation structure 6.

Figure 1G:
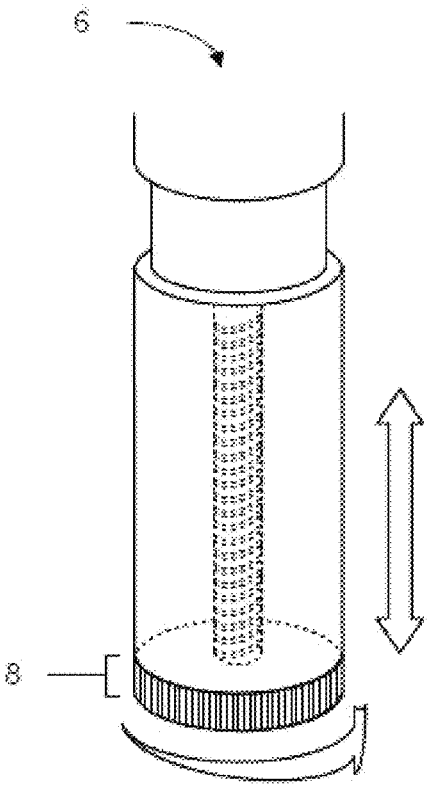

FIG. 1G illustrates an alternate embodiment of the elevation structure 6 with a central screw track situated within a portion of the elevation structure fixed to the slats 2 of the insert. In the illustrated embodiment, the user twists the region 8 of the elevation structure 6. Other embodiments may incorporate other arrangements for fixed or adjustable elevation structures 6.

Figure 2:
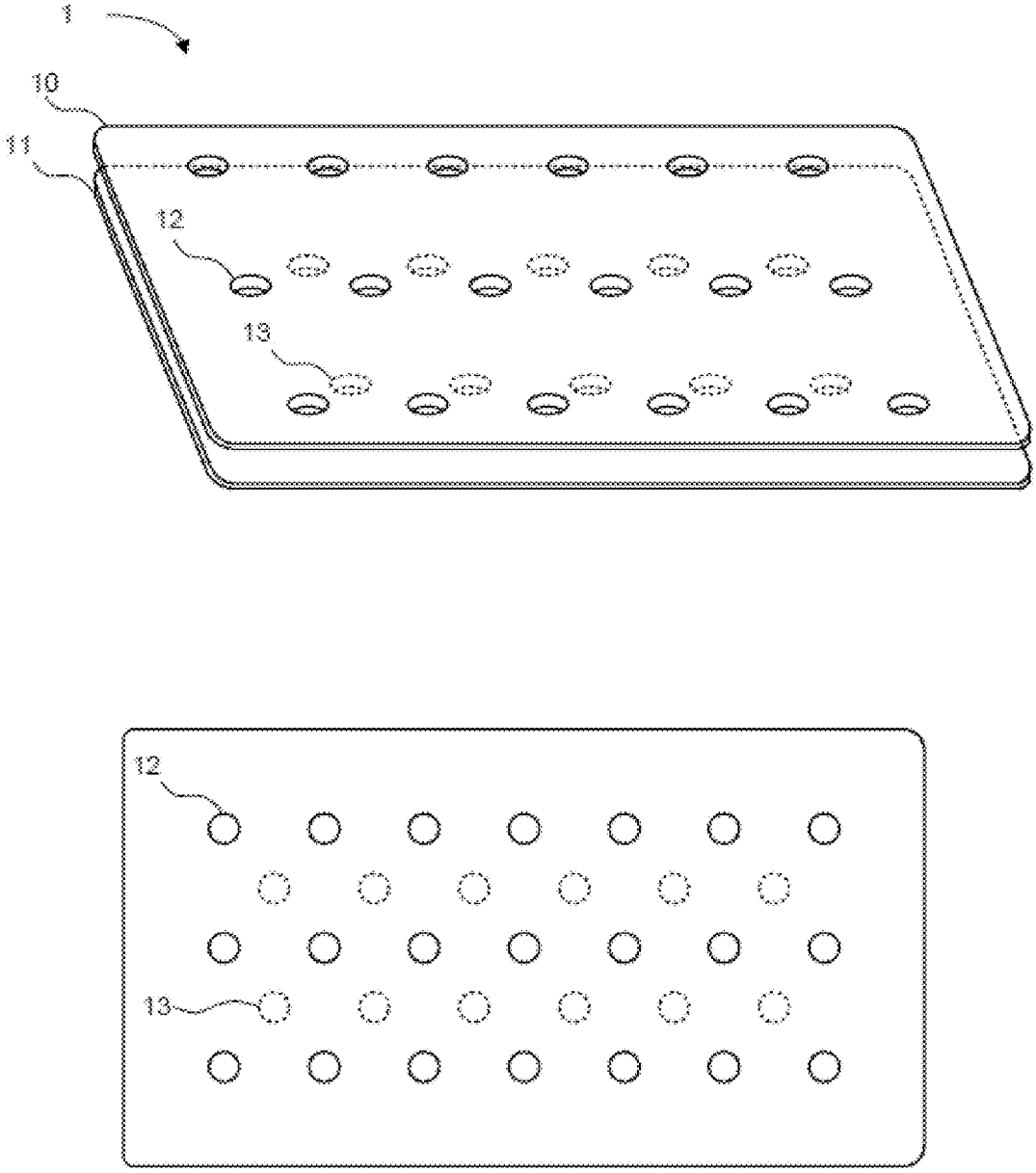
FIG. 2 depicts a schematic diagram of another embodiment of a chest cooler insert with offset drainage structure openings.

FIG. 2 depicts a schematic diagram of another embodiment of a chest cooler insert with offset drainage structure openings. The illustrated embodiment includes an upper plate 10 and a lower plate 11. The upper plate 5 includes an upper drainage structure pattern 12. The lower plate 11 includes a lower drainage structure pattern 13. In the illustrated embodiment, the upper drainage structure pattern 12 is offset from the lower drainage structure pattern 13. This facilitates drainage of water or other material through the upper and lower plates 10 and 11 but increases the resistance to water or other material splashing or sloshing back up through the lower and upper plates 10 and 11.

Figure 3:
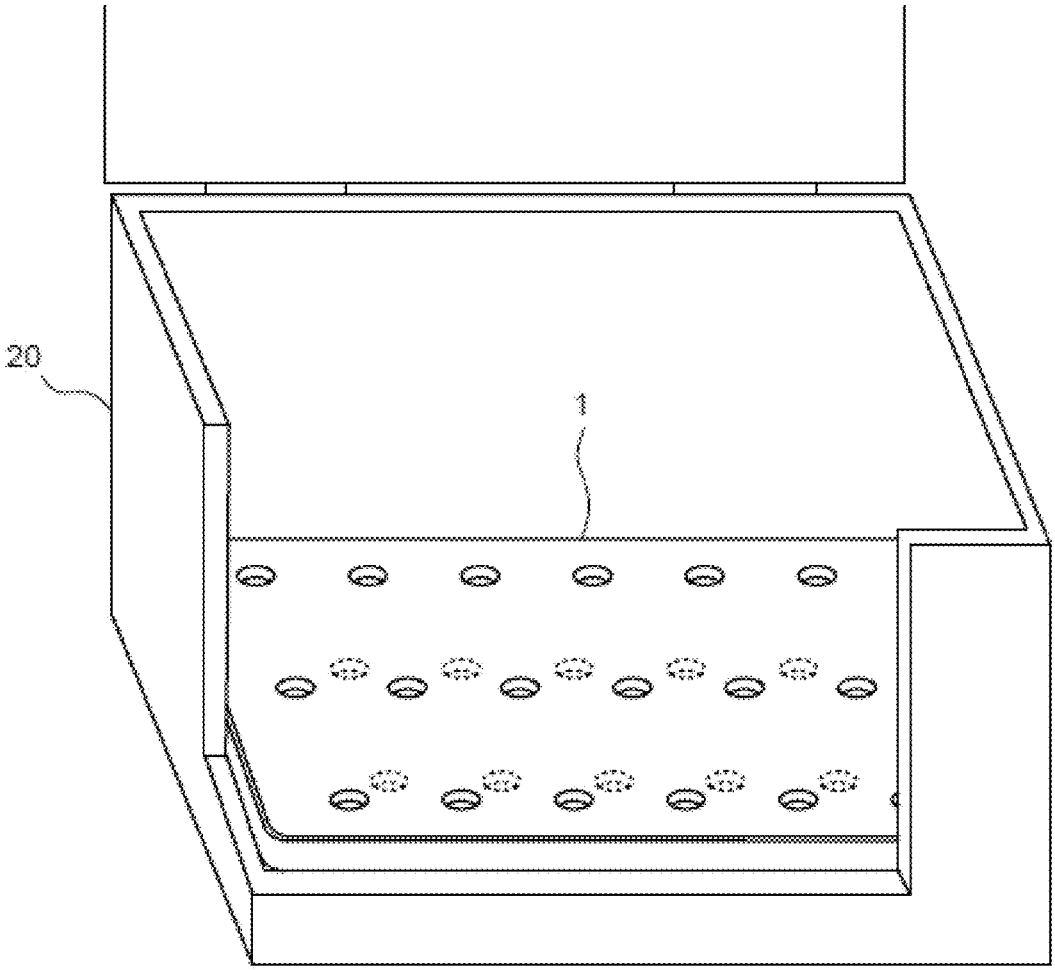
FIG. 3 depicts a schematic diagram of one embodiment of a chest cooler with a cutaway showing the insert of FIG. 1.

FIG. 3 depicts a schematic diagram of one embodiment of a chest cooler with a cutaway showing the insert of FIG. 1. In the illustrated embodiment, the insert 1 is placed in the bottom of the cooler 20. In some embodiments, the insert 1 is removable to provide greater ease in washing and using the insert in multiple applications. In another embodiment, the insert 1 is permanently installed into the bottom of the cooler 20. For example, the insert 1 may be put in place during manufacture of the cooler 20 or inserted after the cooler 20 is formed. In some embodiments, the insert 1 includes suction cups or flanges to attach to the internal sides of the cooler 20. Other manners of securing the insert 1 within the cooler 20 may be implemented.

Figure 4A:
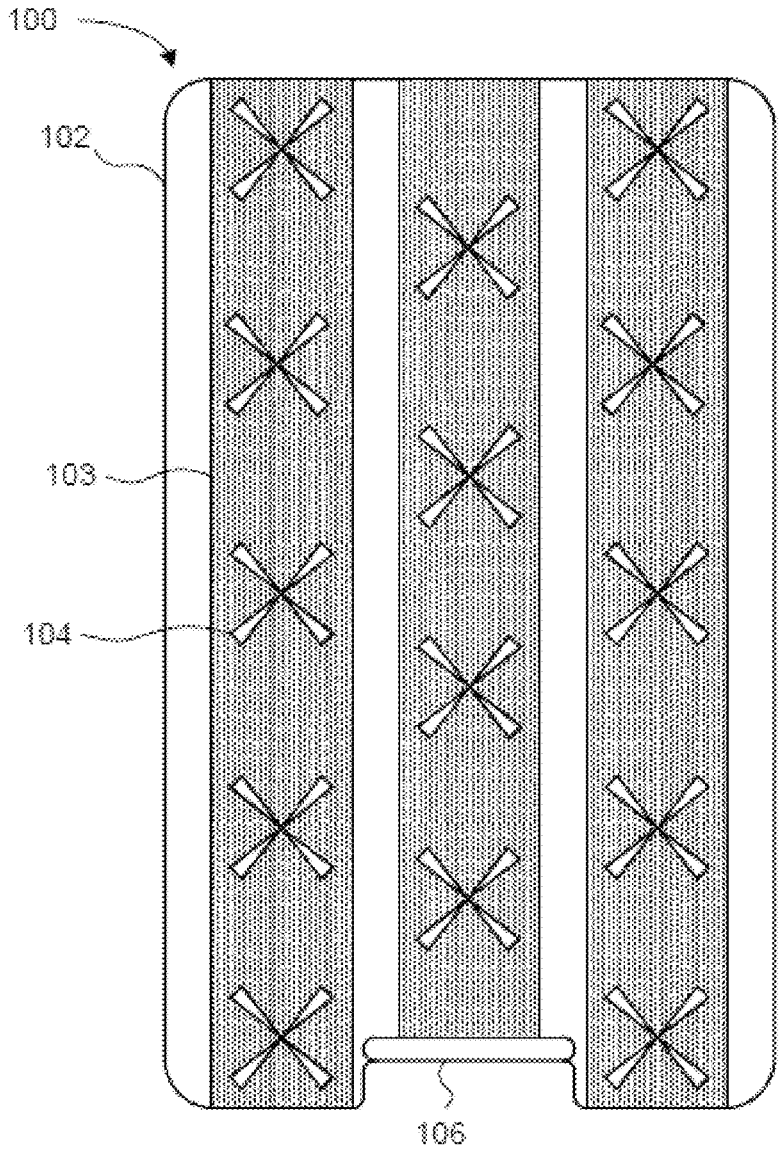
FIGS. 4A and 4B depict schematic diagram views of another embodiment of a chest cooler insert with drainage structure openings.
Figure 4B:
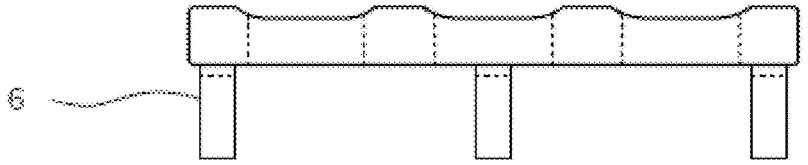

FIGS. 4A and 4B depict schematic diagram views of another embodiment of a chest cooler insert 100 with drainage structure openings. The illustrated embodiment includes a base 102 with surface channels 103 and drainage structures 104. In some embodiments, the base 102 is constructed of a plastic. In other embodiments, the base 102 is constructed of a composite. Other materials may be used without deviating from the scope of the invention. In the illustrated embodiment, the base includes the channels 103. In one embodiment, the channels 103 allow water or other material to flow away from the surface of the insert 100 and into the drainage structures 104. In the illustrated embodiment, the drainage structures 104 are an x-pattern perforation passing completely through the base 102 to allow material to drain through the insert 100. In some embodiments, the drainage structures 104 are circular holes. In other embodiments, the drainage structures 104 are parallel or non-parallel linear slots through the thickness of the base 102. Other embodiments may incorporate other arrangements, patterns, geometries, or sizes of drainage structures 104. In some embodiments, the insert 100 includes a grip point 106. The grip point 106 provides a location on the insert 100 where a user may grip the insert 100 for placing the insert 100 within a cooler or removing the insert 100 from a cooler. In other embodiments, multiple grip points 106 may be included.

In some embodiments, the insert 100 is size adjustable. As described above, the adjustment may be permanent or temporary. In some embodiments, the adjustment includes permanently removing a portion of the insert 100 to accommodate use within a particular size cooler. Other embodiments may include adjustable elements to expand and reduce the size of the insert 100 to accommodate different sizes of coolers. In some embodiments, the insert 100 may maintain a separation from the interior walls of the cooler of approximately 0.5 inches. In some embodiments, the insert 100 includes a flexible flange around the perimeter of the insert 100 to provide a seal and secure the insert 100 within the cooler.

The illustrated embodiment of the insert 100 also includes elevation structures 6 shown in FIG. 4B. The illustrated elevation structures 6 are similar to those described above with reference to FIGS. 1F and 1G. In some embodiments, the elevation structures 6 are suction cups oriented to attach to the sides or bottom surface of a cooler. In another embodiment, the elevation structure 6 include flanges to engage with grooves along the inside surface of a cooler. Other structures may be used to elevate the insert 100 above the bottom surface of a cooler or other surface.

Figure 5:
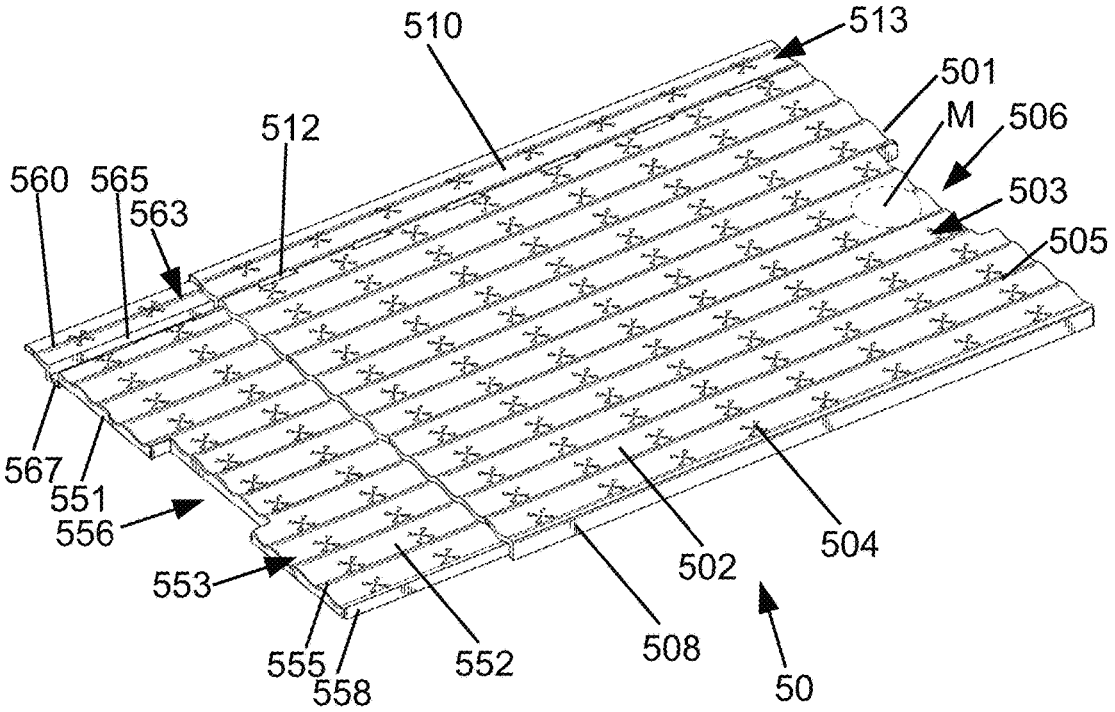
FIG. 5 depicts a top perspective view of another embodiment of a chest cooler insert, which is adjustable for use in different size coolers.
Figure 6:
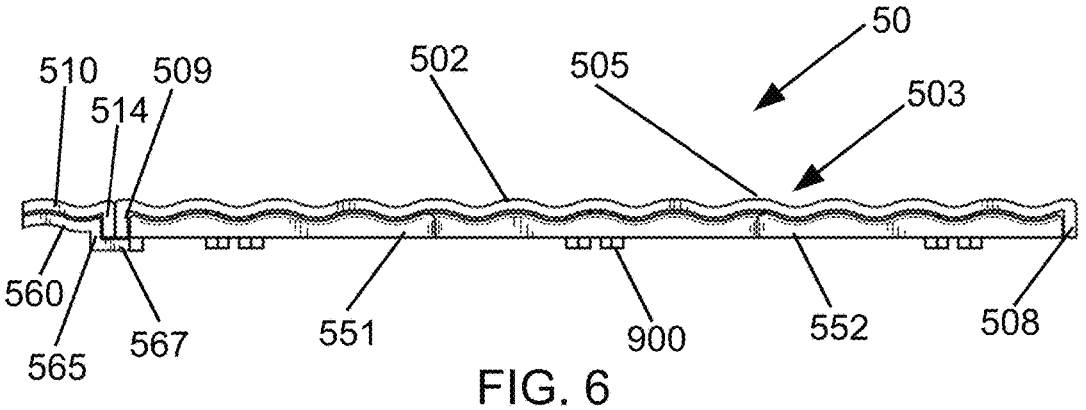
FIG. 6 depicts a front view of the top components of the embodiment of FIG. 5.

FIGS. 5 and 6 depict another embodiment of a chest cooler insert 500 with size adjustment features. The illustrated embodiment includes an upper base 502 with surface channels 503 and drainage structures 504. Each surface channel 503 may be separated from the adjacent channel 503 by a ridge 505, the ridges and channels may be formed through the entire upper base 502, giving it a regularly undulating cross-sectional shape in the depicted embodiment.

Figure 7:
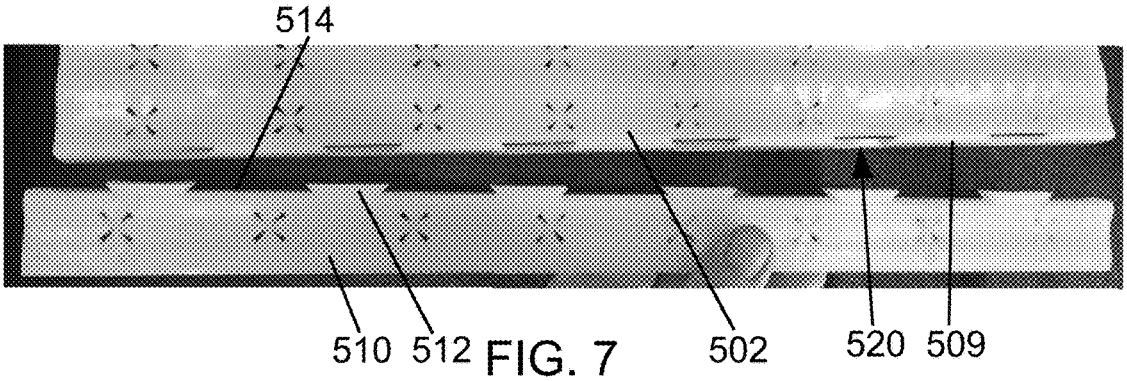
FIG. 7 depicts a portion of the upper top member of the embodiment of FIGS. 5 and 6, with an expandable portion removed.

As depicted, at a first end 501, the upper base 502 may have a handle portion 506 formed as an inset to allow a user to place their hand therein when the base is adjacent a cooler interior wall, and have a downwardly extending outer rim or wall, which extends around a corner to join a downwardly extending longitudinal sidewall 508 along a first longitudinal side of the base 502. The opposite second end 507 may lack such a wall. Along the second longitudinal side of the base 502, a downwardly extending longitudinal sidewall 509 similarly joins the downwardly extending wall or rim on the first end 501. As best depicted in FIG. 7, a series of connection notches 520 may be formed in the sidewall 509 at the top corner thereof in the upper surface of the base 502.

An upper expansion member 510 may be joined to the upper base 502 by placement of the counterpart connection tabs 512 into to the connection notches 520. In the depicted embodiment, the upper expansion member 510 has an upper surface with at least one surface channel 513 containing drainage structures 504, to form a continuous surface with the upper surface of the upper base 502 upon joining. A downwardly extending longitudinal sidewall 514 may abut the longitudinal sidewall 509 of the upper base member 502 as best depicted in FIG. 6 to form an elongated tab.

The illustrated embodiment also includes a lower base 552 with surface channels 553 and drainage structures 554. Each surface channel 553 may be separated from the adjacent channel 553 by a ridge 503, the ridges and channels may be formed through the entire upper base 552, giving it a regularly undulating cross-sectional shape in the depicted embodiment.

Figure 8:
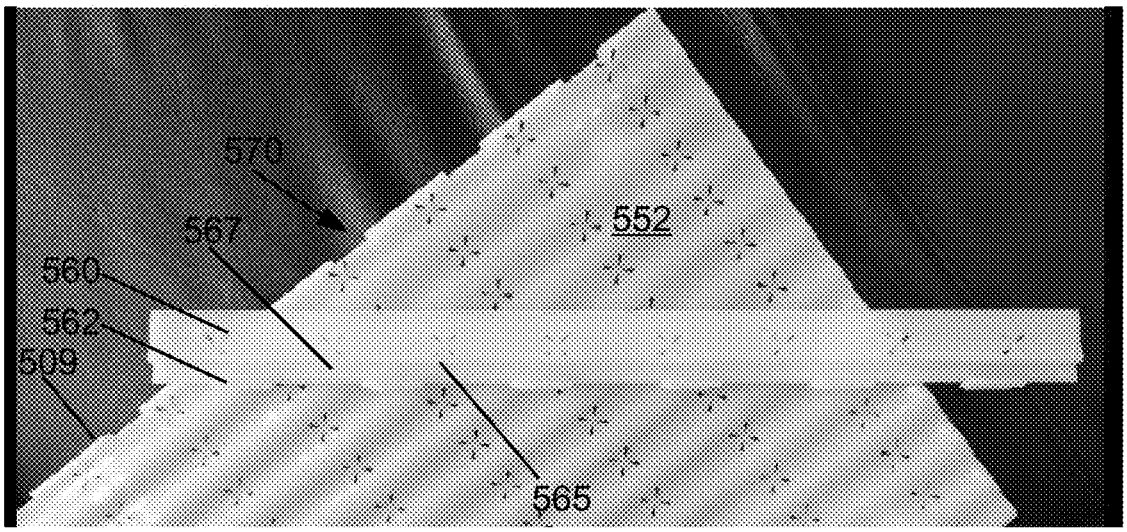
FIG. 8 depicts a portion of the lower top member of the embodiment of FIGS. 5 and 6, with an expandable portion removed.

As depicted, at a first end 551, the lower base 552 may have a handle portion 556 formed as an inset to allow a user to place their hand therein when the base is adjacent a cooler interior wall, and have a downwardly extending outer rim or wall, which extends around a corner to join a downwardly extending longitudinal sidewall 558 along a first longitudinal side of the base 552. Along the second longitudinal side of the base 552, a downwardly extending longitudinal sidewall 561 similarly joins the downwardly extending wall or rim on the first end 551. As best depicted in FIG. 8, a series of connection notches 570 may be formed in the sidewall 561 at the top corner thereof in the upper surface of the base 552.

A lower expansion member 560 may be joined to the lower base 552 by placement of the counterpart connection tabs 562 into to the connection notches 570. In the depicted embodiment, the upper expansion member 560 has an upper surface with at least one surface channel 563 containing drainage structures 504, similar to the upper surface of the lower base 552 that will be generally coplanar thereto upon joining. A downwardly extending longitudinal sidewall 565 extends along one side of the lower expansion member 560 and a planar member 567 extends generally orthogonally therefrom. The connection tabs 562 may be disposed on the opposite side of the planar member 567. Upon installation to the lower base 552, the longitudinal sidewall 565 faces the longitudinal sidewall 509 of the lower base member 552 to form a channel with the planar member 567 forming the "floor" thereof.

The matching patterns of the channels and ridges of the upper and lower base members 502 and 552 and the upper and lower expansion members 510 and 560 allow for a close fit therebetween. Where the expansion members are attached, the parallel longitudinal sidewalls 509 and 514 of the upper base 502 and upper expansion member 510 reside in the channel formed between the sidewalls 565 and 509 of the lower expansion member 560 and the lower base 552, as best depicted in FIG. 6.

The relative position of the upper and lower bases 502 and 552 may be telescopically adjusted with respect to one another by sliding movement. This allows the insert 50 to be adjusted in a longitudinal direction to fit in the interior space of coolers of different sizes. Similarly, the ability to connect and disconnect the upper and lower expansion members 510 and 560 to the bases allows for the insert 50 to be adjusted in a latitudinal direction for placement in coolers of different sizes. The ability of the expansion members 510 and 560 to be slidably adjusted with respect to one another as the abutting sidewalls 509 and 514 reside in the channel allows for adjustment in both directions separately. It will be further appreciated that in some embodiments, both longitudinal edges of the bases 502 and 552 may be configured for and joined to expansion members.

In some embodiments, the bases 502 and 552 may be constructed of a plastic. In other embodiments, the bases 502 and 552 may be constructed of a composite. Other materials may be used without deviating from the scope of the invention. In the illustrated embodiment, the bases includes the channels 503 and 513, which allow water or other material to flow away from the surface of the insert 50 and into the drainage structures 504. In the illustrated embodiment, the drainage structures 504 are an x-pattern perforation passing completely through the base 502 or 552 to allow material to drain through the insert 50. In some embodiments, the drainage structures 504 are circular holes. In other embodiments, the drainage structures 504 are parallel or non-parallel linear slots. Other embodiments may incorporate other arrangements, patterns, geometries, or sizes of drainage structures 504. In some embodiments, the insert 50 may include a medallion M formed as an area to bear a logo or other identifying matter.

It will be appreciated that the shapes of the depicted connection tabs 512 and 562 and corresponding connection notches 520 and 570 are illustrative and that any suitably shaped structures may be used.

In some embodiments, the insert 50 may include a flexible flange around the perimeter of the insert 50 to provide a seal and secure the insert 100 within a cooler.

Figure 9:
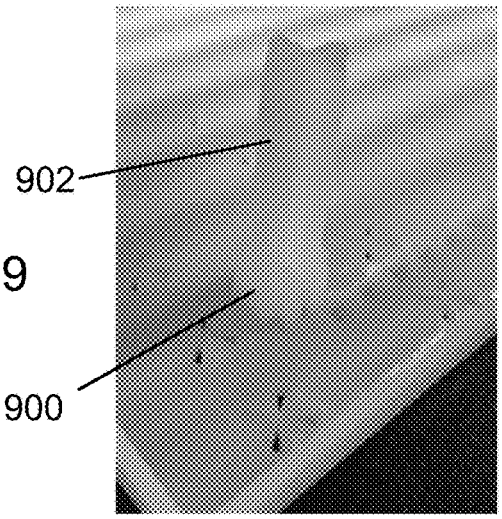
FIG. 9 depicts a portion of the lower surface of the embodiment of FIGS. 5 through 8 depicting the components of an elevation structure thereof.

The illustrated embodiment of the insert 50 also includes elevation structures shown in FIG. 9. The illustrated elevation structures a number of brackets 900 disposed on the lower surfaces of the bases 502 and 552. In the depicted embodiment, the bracket 900 is formed as a protuberance containing two slots that form an x-shape. A leg member 902 having an x-shaped cross-section can be inserted into the bracket to form a leg holding the insert 50 above the floor of the cooler. It will be appreciated that other elevation structures, such as ones similar to those described above with reference to FIGS. 1F and 1G may be used. In other embodiments, the elevation structures could be suction cups oriented to attach to the sides or bottom surface of a cooler, flanges to engage with grooves along the inside surface of a cooler, or other structures that may be used to elevate the insert 50 above the bottom surface of a cooler or other surface. In other embodiments, the elevation structures could be recesses or portions of the insert 50 that receive support from structures formed on an interior surface of a cooler, such as protrusions or a ridge formed thereon for holding shelves or dividers. It will be appreciated that different numbers and patterns of elevation structures, including brackets 900 and legs 902 or other structures may be used, depending on the size and strength of the insert 50.

While this disclosure has been described in certain embodiments, the present invention can be further modified with the spirit and scope of this disclosure. This application is therefore intended to cover any variations, uses, or adaptations of the invention using its general principles. Further, this application is intended to cover such departures from the present disclosure as come within known or customary practices in the art to which this invention pertains and which fall within the limits of the appended claims.

What is claimed is:

1. A drainage insert for holding items stored in a cooler above a bottom surface of the cooler, comprising:

an adjustable platform for holding items above the bottom of a cooler, wherein the platform includes at least one drainage opening for allowing liquid to pass therethrough and comprises an upper base member with an upper surface and a lower surface and lower base member with an upper surface and lower surface, wherein the upper base member and lower base member each have a regularly undulating cross section, and at least a portion of the lower surface of the upper base member is disposed atop at least a portion of the upper surface of the lower base member and the upper and lower base members are telescopically adjustable to one another along a first axis of the adjustable platform, with the upper surface of the upper base member and the exposed upper surface of the lower base member comprising the upper surface of the adjustable platform.

2. The drainage insert of claim 1, wherein the upper base member and lower base member each have a series of channels formed therein that correspond to one another.

3. A drainage insert for holding items stored in a cooler above a bottom surface of the cooler, comprising:

an adjustable platform for holding items above the bottom of a cooler, wherein the platform includes at least one drainage opening for allowing liquid to pass therethrough, and wherein the adjustable platform comprises an upper base member with an upper surface and a lower surface and lower base member with an upper surface and lower surface, wherein at least a portion of the lower surface of the upper base member is disposed atop at least a portion of the upper surface of the lower base member and the upper and lower base members are telescopically adjustable to one another along a first axis of the adjustable platform, with the upper surface of the upper base member and the exposed upper surface of the lower base member comprising the upper surface of the adjustable platform;

an upper expansion member having an upper surface and being removably attached to the upper base member so the upper surface of the upper expansion member and the upper surface of the upper base member form a continuous upper surface and a lower expansion member having an upper surface and being removably attached to the lower base member so the upper surface of the lower expansion member and the upper surface of the lower base member form a continuous upper surface, wherein the upper expansion member and lower expansion member are telescopically adjustable to one another along the first axis of the adjustable platform; and at least one leg that elevates the adjustable platform above the bottom surface of a cooler.

4. The drainage insert of claim 3, wherein the upper expansion member is removably attachable to the upper base member by a set of connection tabs that are placed in corresponding connection notches.

5. The drainage insert of claim 3, wherein the lower expansion member is removably attachable to the lower base member by a set of connection tabs that are placed in corresponding connection notches.

6. The drainage insert of claim 3, wherein the lower expansion member and the lower base define a channel parallel to the first axis of the adjustable platform and the upper expansion member and upper base member define a ridge that resides in the channel.

7. The drainage insert of claim 1, wherein the at least one drainage opening comprises at least one perforation through the adjustable platform.

8. The drainage insert of claim 7, wherein the at least one drainage opening comprises a set of perforations that are disposed in a series of channels in the adjustable platform.

9. The drainage insert of claim 1, further comprising a set of brackets disposed on the lower surface of the adjustable platform and a set of leg members that are inserted into the brackets.

10. A cooler insert for holding items stored in a cooler above a bottom surface of the cooler, comprising:

an adjustable platform for holding items above the base of a cooler which is selectively adjustable in at least one horizontal direction, the adjustable platform comprising an upper base member with an upper surface and a lower surface and a lower base member with an upper surface and lower surface, wherein at least a portion of the lower surface of the upper base member is disposed atop at least a portion of the upper surface of the lower base member and the upper and lower base members are telescopically adjustable to one another along a first axis of the adjustable platform, with the upper surface of the upper base member and the exposed upper surface of the lower base member comprising the upper surface of the adjustable platform;

an upper expansion member having an upper surface and being removably attachable to the upper base member so the upper surface of the upper expansion member and the upper surface of the upper base member form a continuous upper surface;

a lower expansion member having an upper surface and being removably attachable to the lower base member so the upper surface of the lower expansion member and the upper surface of the lower base member form a continuous upper surface, wherein the upper expansion member and lower expansion member are telescopically adjustable to one another along the first axis of the adjustable platform; and at least one leg that elevates the adjustable platform above the bottom surface of a cooler.

11. The cooler insert of claim 10, wherein the upper expansion member is removably attachable to the upper base member by a set of connection tabs that are placed in corresponding connection notches.

12. The cooler insert of claim 10, wherein the lower expansion member and the lower base define a channel parallel to the first axis of the adjustable platform and the upper expansion member and upper base member define a ridge that resides in the channel.

13. The cooler insert of claim 10, further comprising a set of drainage openings that comprises perforations that are disposed in a series of channels in the adjustable platform.

14. The cooler insert of claim 13, wherein the perforations comprise a set of cross shaped openings through the adjustable platform.

15. The drainage insert of claim 3, wherein the at least one leg that elevates the adjustable platform above the bottom surface of a cooler comprises a set of legs that are removably attachable to the adjustable platform.

16. The drainage insert of claim 15, wherein the set of legs comprises a set of leg members that are inserted into a set of brackets disposed on the lower surface of the adjustable platform.

17. The cooler insert of claim 10, wherein the at least one leg that elevates the adjustable platform above the bottom surface of a cooler comprises a set of legs that are removably attachable to the adjustable platform.

18. The cooler insert of claim 17, wherein the set of legs comprises a set of leg members that are inserted into a set of brackets disposed on the lower surface of the adjustable platform.

* * * * *